United States Patent [19]

Gaskins

[11] Patent Number: 4,508,383

[45] Date of Patent: Apr. 2, 1985

[54] RESILIENT BLADDER TYPE SUSPENSION SYSTEM FOR A SUPPORT STRUCTURE SUCH AS A CHAIR, BED, OR THE LIKE

[76] Inventor: Karl S. Gaskins, 117 W. Park Dr., Raleigh, N.C. 27605

[21] Appl. No.: 412,399

[22] Filed: Aug. 30, 1982

[51] Int. Cl.[3] ..... A47C 7/14; A47C 7/46

[52] U.S. Cl. ..... 297/284; 5/447; 297/458; 297/460; 297/DIG. 3

[58] Field of Search ..... 297/284, 445, 458, 460, 297/DIG. 3; 5/431, 446, 447

[56] References Cited

U.S. PATENT DOCUMENTS 4,235,473 11/1980 Aginar ..... 297/445 X 4,306,322 12/1981 Young et al. ..... 297/284 X

FOREIGN PATENT DOCUMENTS 2513270 10/1976 Fed. Rep. of Germany ... 297/DIG. 3

*Primary Examiner*—William E. Lyddane

*Assistant Examiner*—Peter R. Brown

*Attorney, Agent, or Firm*—Mills & Coats

[57] ABSTRACT

The present invention entails a body support structure such as a chair, bed or the like that is provided with an inflated bladder interposed between a plurality of load carrying members and a main frame that allows the plurality of load carrying members to be depressed independently of each other and to, as a group, generally conform to the shape of the load being supported. In the design of a chair and the seat therefor, for example, the chair is provided with two side frames. Each side frame receives and retains an elongated inflated bladder with upper segments of the bladder being exposed. A plurality of independent transversely extending seat members or slats span said two side frames with each seat member or slat about opposite ends resting over and generally supported by said bladder. Thus, the bladder tends to support the respective seat members or slats in a floating-resilient type fashion.

8 Claims, 8 Drawing Figures

RESILIENT BLADDER TYPE SUSPENSION SYSTEM FOR A SUPPORT STRUCTURE SUCH AS A CHAIR, BED, OR THE LIKE

FIELD OF INVENTION

The present invention relates to support structures such as chairs, beds, or the like, and more particularly to such support structures provided with a fluid suspension system for a load carrying section thereof.

BACKGROUND OF INVENTION

Furniture that is upholstered is often aesthetically desirable because of the presence of high quality and attractive wood such as walnut, oak, etc. However, in the case of chairs for example, to have a rigid wood seat, one would expect some sacrifice in comfort. Rigid seat structures have been contoured and this has resulted in the seat being more comfortable. But still a rigid and inflexible seat leaves a great deal to be desired in comfort.

SUMMARY AND OBJECTS OF THE INVENTION

The present invention entails a body support structure such as a chair that is provided with a rigid body support structure that is suspended about or on a fluid containing bladder. In the case of a chair design disclosed herein, the seat and back areas are each provided with a plurality of rigid slat-like members movably mounted for resilient movement against an air inflated bladder which allows each individual rigid slat member to move independently of each other and allows a group of slat members to easily conform to the shape of a body disposed thereagainst.

In the case of a chair design disclosed herein, an elongated air inflated bladder is interposed between two laterally spaced side frames, and a series of transverse slats that form the seat. The respective slats include opposite end portions that engage the inflated bladder and wherein the bladder is secured to the respective slats and to the side frames in such a manner that the bladder tends to tie the side frames and slats together to form an integral structure. This design enables the individual seat slats to move independently of each other and to conform to the body or seat area of an individual occupying the chair structure.

As will be disclosed herein, the same basic design is provided for a seat back structure. Further, it will be appreciated that the same type of inflated bladder suspension system can be utilized in other body support structures such as beds or the like.

It is, therefore, an object of the present invention to provide a body support structure such as a chair, bed or the like with a fluid suspension system.

Another object of the present invention resides in the provision of a body support structure with a fluid suspension system for resiliently suspending a load carrying section having a plurality of independent rigid slats in such a manner that the individual slats can move independently of each other under the influence of a load.

A further object of the present invention is to provide a fluid suspension system for a body support structure that is capable of being incorporated into various types of support structures such as chairs, beds, and other such types of furniture.

Another object of the present invention resides in the provision of a body support structure and fluid suspension system therefor that is particularly provided with an inflated bladder that is interposed between a load carrying section and a frame structure and wherein the load carrying section is movable toward and away from the frame structure as a result of the presence of the air inflated bladder.

It is also an object of the present invention to provide a body support structure such as a chair, bed or the like with a fluid suspension system of the character referred to above that is relatively simple in design and which is durable and relatively free of maintenance.

A further object of the present invention resides in the provision of a chair with a fluid suspended seat and back structure.

It is also an object of the present invention to provide a chair of the character referred to above that is provided with an air inflated bladder that is generally elongated and which is interposed between a main frame structure of the chair and a plurality of slats forming the seat of the chair and between the main frame structure and a plurality of back slats that form the back of the chair.

Other objects and advantages of the present invention will become apparent from a study of the following description and the accompanying drawings which are merely illustrative of the present invention.

FLUID SUSPENSION SYSTEM FOR A CHAIR OR THE LIKE

Figure 1:
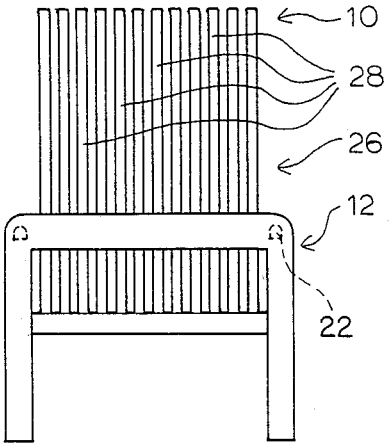
FIG. 1 is a front elevational view of a chair structure having the fluid seat and back suspension system of the present invention incorporated therein.
Figure 2:
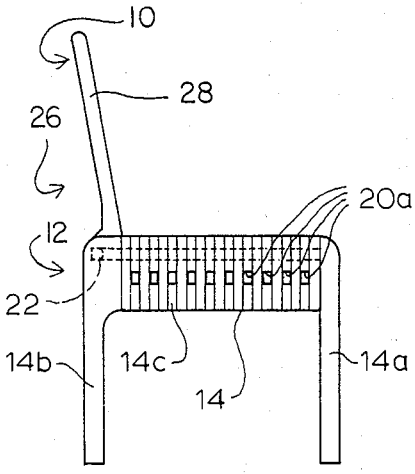
FIG. 2 is a side elevational view of the chair shown in FIG. 1.
Figure 3:
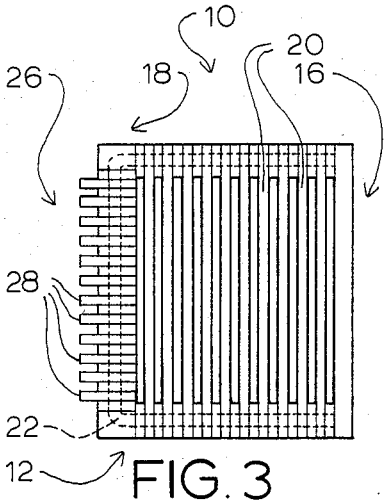
FIG. 3 is a top plan view of the chair shown in FIG. 1.

With further reference to FIGS. 1 through 3, the body support structure provided with the fluid suspension system of the present invention is shown therein in the form of a chair, indicated generally by the numeral 10. The present fluid suspension system will be described and illustrated in the context of chair 10, but with the understanding that the same fluid suspension system could be incorporated into other such support structures such as beds or the like.

Referring to FIGS. 1 through 3, it is seen that chair 10 comprises a main frame structure indicated generally by the numeral 12. Main frame structure 12 includes a pair of side frames 14. Each side frame includes a front leg 14*a*, a rear leg 14*b*, and an interconnecting longitudinal section 14*c*.

Side frames 14 are connected about the front by a front cross member 16 and about the rear by a rear transverse member or assembly 18.

Figure 5:
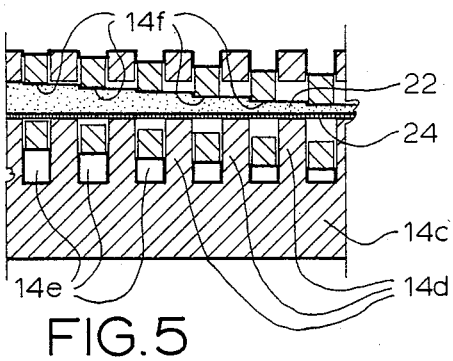
FIG. 5 is a longitudinal sectional view taken through a portion of a side frame structure of the chair shown in FIGS. 1 through 3 illustrating the side frame structure, bladder and the end portion of respective elongated slats forming the seat of the chair.
Figure 6:
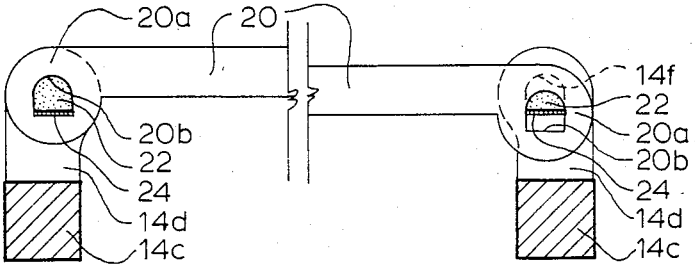
FIG. 6 is a transverse sectional view through the seat and side frame structure of the chair shown in FIGS. 1 through 3.

Continuing to refer to side frames 14 and particularly the longitudinal section 14*c* thereof, it is seen in FIGS. 5 and 6 that there is provided a plurality of upstanding bladder holding arms 14*d* that extend upwardly from longitudinal section 14*c*. Defined between respective bladder holding arms 14*d* is a series of voids 14*e*. Formed within each bladder holding arm 14*d* is an opening 14*f* and it is seen that the openings 14*f* are formed and disposed in longitudinal alignment.

Spanning side frames 14 is a series of independent seat members or slats 20 that form the seat or seat area of chair 10. Respective seat slats 20 include a bladder holding arm 20*a* formed about each end thereof. Each end bladder holding arm includes an opening 20*b* that conforms in shape and size to openings 14*a* in the bladder holding arms 14*d* extending upwardly from the longitudinal section 14*c* of the respective side frames 14.

To provide the fluid suspension for the respective seat slats 20, an inflated bladder 22 such as an bicycle tire inner tube is threaded through openings 14*f* in bladder holding arms 14*b* as well as openings 20*b* in bladder holding arms 20*a* forming a part of the end portions of the respective seat slats 20. Underlying bladder 22 is a liner 24, such as a nylon liner. In the present disclosure, the presence of nylon liner 24 generally supports bladder 22 in the areas where the same stretches and spans the respective voids 14*e*.

Consequently, it is appreciated that the bladder 22 also tends to integrally connect the respective seat slats 20 with the side frames 14. Further, the respective seat slats 20 under the influence of a load tend to generally depress the bladder 22 and are supported by the air or fluid therein. Once the load is removed from the seat slats 20, it is appreciated that the resilient nature of the bladder 20 will cause the seat slats 20 to assume their normal upper unloaded position. It is further seen that the presence of the bladder 22 in the design illustrated herein enables the respective slats 20 to move upwardly and downwardly independently of each other and to generally conform to the shape of the load or body assuming a sitting position thereover.

Now turning to the back structure, indicated generally by the numeral 26, of the chair 10, it is seen that the same comprises a series of slats 28. Slats 28, like seat slats 20, are independently mounted with respect to each other.

Figures 7, 8:
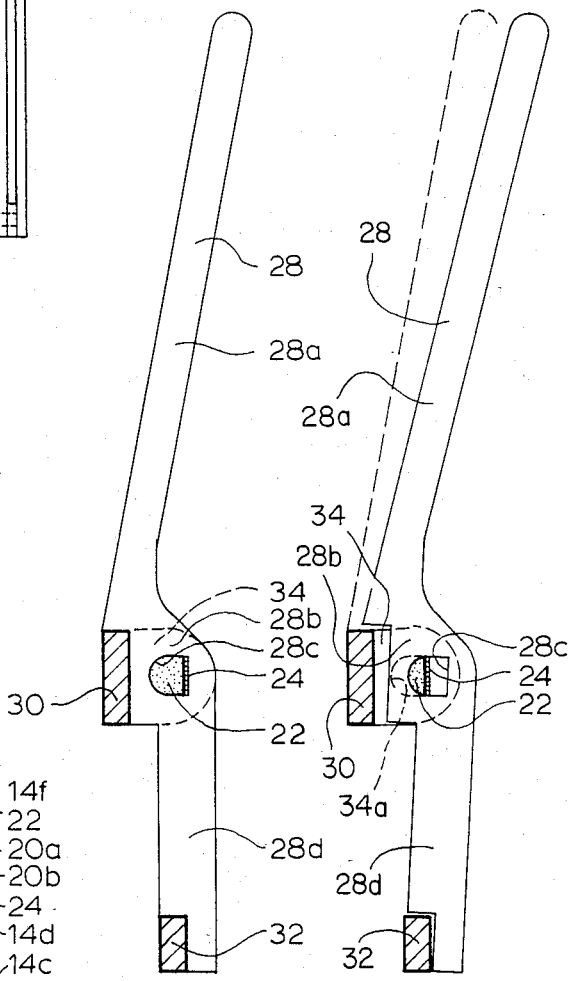
FIG. 7 is a fragmentary sectional view taken through the back of the chair shown in FIGS. 1 through 3 with the individual slat being in its forwardmost position.
FIG. 8 is a sectional view similar to FIG. 7 with the individual back slat being rotated a slight amount clockwise.

To support the respective slats 28, the rear transverse member 18 or assembly is provided with a series of laterally spaced bladder holding arms 34 that project rearwardly in spaced apart relationship from an upper stop bar 30, as best viewed in FIGS. 7 and 8. The respective bladder holding arms 34 include an opening 34*a* and the respective openings of bladder holding arms 34 are aligned so to receive a bladder 22 in a fashion and manner similar to that discussed hereinabove with respect to the seat and side frame structure of the chair 10.

Disposed below the upper stop bar 30 is a lower stop bar 32 that extends transversely across the rear of the chair 10 and is supported thereat by the chair's main frame structure 12.

Viewing the design of a particular slat 28, it is seen that the same includes a back rest portion 28*a*, a bladder holding section 28*b*, an opening 28*c* in the bladder holding section 28*b*, and a lower lever arm 28*d* that normally engages the back side of lower stop bar 32. In an unloaded position as illustrated in FIG. 7, openings 28*c* in the bladder holding section 28*b* of each back slat are aligned generally with the openings 34*a* in the bladder holding arms 34 that project rearwardly from upper stop bar 30.

In like fashion to that already discussed with respect to FIG. 5 and the seat structure of chair 10, a bladder in the form of an inflated inner tube or other fluid containing bladder device is threaded through openings 34*a* of the bladder holding arms 34 and through openings 28*c* of the bladder holding section 28*b* of the respective back slats 28. A liner 24 is interposed between the bladder 22 and the load bearing area of the openings 34*a*. Because the respective slats 28 under load will tend to swing from left to right as viewed in FIGS. 7 and 8, it is appreciated that liner 24 should assume a generally vertical posture and be positioned to the right of bladder 22 as viewed in FIGS. 7 and 8.

In the case of the bladder construction 22 with respect to chair 10, it is appreciated that the bladder could extend in one integral construction in a U-shaped fashion through the side frames 14 and through the back slats 28 and associated structure. Further it is appreciated that the bladder could be installed in selected sections within the chair 10.

Once an individual leans back on the back slats 28, they will tend to move left to right as viewed in FIGS. 7 and 8. As a load is applied, it is appreciated that bladder holding section 28*b* of the individual back slats 28 will tend to compress bladder 22 as the bladder holding section moves to the right. Compression is effectuated since the bladder holding arms 34 and the openings 34*a* therein in cooperation with liner 24 tends to maintain the right vertical side of bladder 22 stationary. Consequently, once an individual removes himself from the chair 10 and releases the load against slats 28, the air within the bladder 22 will tend to force the slats 28 to move right to left to where the respective slats are maintained in an upright nonloaded position by the engagement of upper stop bar 30 with the front portion of bladder holding section 28*b*. It is further appreciated that lower stop bar 32 tends to stabilize the respective back slats 28 and to restrict or limit the left to right swinging movement of the same when the slats are under load.

Figure 4:
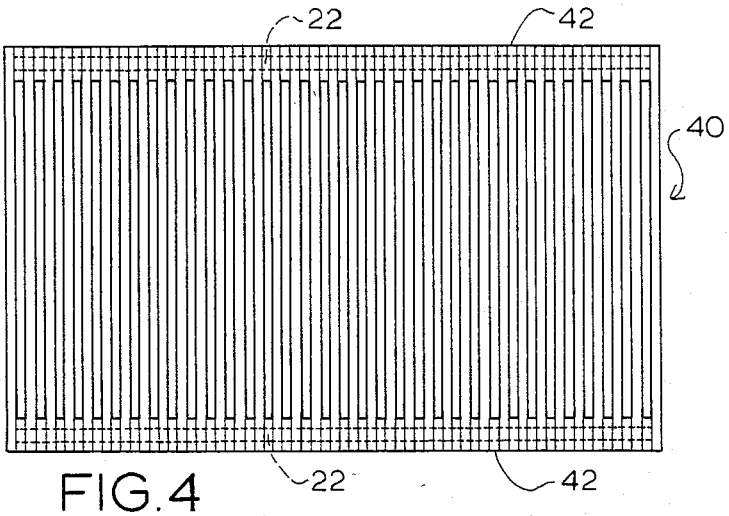
FIG. 4 is a plan view of a bed type structure constructed in accordance with the present invention.

As pointed out hereinabove, the body support structure with the fluid suspension system of the present invention can be incorporated into other types of structures. For example, in FIG. 4, there is illustrated a bed type structure indicated generally by the numeral 40 that is provided with the fluid suspension system of the present invention. Details of this design will not be dealt with herein in detail because such would follow the same basic design as the seat structure of the chair 10 already discussed herein and particularly illustrated in FIGS. 1 through 3 and more particularly in FIG. 5. Briefly, bed structure 40 would include a pair of longitudinal sections 42 with a series of transverse slats 44 interconnected therebetween and with a bladder 22 extending through the longitudinal sections 42 and which tends to integrally connect transverse slats 44 with the longitudinal sections 42. It is appreciated that the respective slats 44 would be capable of moving up and down independently of each other and would also further be capable of generally conforming to the body shape of an individual or load supported thereover.

From the foregoing discussion and specification, it is appreciated that the present invention presents a body support structure such as a chair, bed or the like with a fluid suspension system. In particular the body support structure includes a series of individual slat members that are movable relatively to each other in independent fashion in association with the fluid suspension system and which can accordingly conform to the shape of an individual being supported thereby.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A body support structure such as a chair, bed or the like provided with a fluid bladder type suspension system comprising: a main frame structure having a load bearing area and an elongated bladder holding area; body support means incorporated into said body support structure and extending adjacent said main frame structure and including bladder receiving means; a fluid receiving elongated inflatable bladder adapted to contain air interposed between said load bearing area of said main frame structure and said body support means providing a fluid cushion type support for said body support means and which enables said body support means when under load to move in a floating fashion with respect to said main frame structure; said elongated inflatable bladder being held by the bladder holding area of said main frame structure and said bladder receiving means of said body support means such that said elongated bladder tends to connect said body support means with said main frame; said bladder holding area of said main frame structure being formed by a plurality of spaced apart bladder holding arms with respective bladder holding arms of said main frame structure including an opening formed therein for receiving said elongated inflatable bladder; and wherein said body support means including a plurality of independent support members with each of said support members including a bladder holding arm with an opening formed therein and wherein said bladder holding arms of said main frame structure and wherein said elongated inflatable bladder is threaded through the openings of said bladder holding arms of both said main frame structure and said plurality of independent support members.

2. The body support structure of claim 1 further including a liner extending along and adjacent to said elongated inflatable bladder and disposed adjacent said load bearing area of said main frame structure.

3. The body support structure of claim 1 wherein voids are provided between said bladder holding arms of said main frame structure and wherein said bladder holding arms of said support members extend into and occupy said voided areas such that said bladder holding arms of said support member are disposed in alternating fashion adjacent said bladder holding arms of said main frame such that said elongated inflatable bladder can be threaded through the respective openings of said bladder holding arms of said main frame structure as well as said bladder holding arms of said support members.

4. The body support structure with said bladder suspension system of claim 3 wherein said main frame structure includes a pair of laterally spaced side frames with each side frame including a plurality of said bladder holding arms of said main frame structure with said respective bladder holding arms projecting upwardly and aligned in spaced apart relationship; and wherein said plurality of support members of said body support means are elongated and span across said laterally spaced side frames and wherein opposite ends of said support members include said bladder holding arms of said body support means and wherein said bladder holding arms of said support members are disposed between respective body holding arms of said side frames.

5. The body support structure with said bladder suspension system of claim 1 wherein said bladder suspension system is incorporated into a chair back and wherein said body support means includes a plurality of independent and upstanding back support members; and wherein said main frame structure includes a transverse member extending adjacent said back support members and having a series of laterally spaced bladder holding arms that project therefrom between respective back support members, and wherein said bladder holding arms of said transverse means include means for retaining said bladder with respect to said back support members such as said back support members are leaned against the bladder the same tends to compress said bladder and move rearwardly with respect to said chair structure so as to give rise to a resilient type back suspension system for said chair.

6. The chair type structure with said resilient type back suspension system of claim 5 wherein said back support members includes transversely aligned openings formed about an intermediate area between upper and lower ends thereof with said bladder being threaded through said openings in said back support members as well as openings formed within openings of said bladder holding arms such that said bladder tends to integrally tie said back support members with said transverse member of said main frame.

7. The chair type structure having said resilient back suspension system of claim 6 further including a stop bar disposed transversely adjacent the forward side of said back support members generally adjacent the disposition of said bladder so as to limit the forward movement of said back support members and wherein when a load is placed against said back support members the same tends to move rearwardly away from said stop member; and wherein disposed below said stop member is a second stop member that extends transversely across the front of said back support members about the lower ends thereof so as to effectively limit the rearward movement of said back support members when a load is placed thereagainst.

8. A body support structure such as a chair or bed provided with a plurality of spaced apart transversely extending body conforming slats supported on a fluid bladder type suspension system such that the slats may move independently up and down and generally conform to the shape of one's body supported thereby, said body support structure comprising: a main frame structure having a laterally spaced bladder load bearing area; fluid receiving bladder means supported on said laterally spaced bladder load bearing area of said main frame structure for providing a fluid cushion type support structure; a plurality of spaced apart and independent floating body support slats disposed across said main frame structure and extending in side-by-side relationship between said laterally spaced bladder means; said plurality of floating body support slats including a series of independent slats with each slat having opposed end portions that operatively engage and are supported by said laterally spaced bladder means such that the respective slats may move up and down independently of each other to generally conform to the shape of a body supported thereby; and slat alignment means supported between adjacent end portions of the respective independent slats for maintaining alignment of the respective slats as the same float independently up and down on said laterally spaced bladder means.

* * * * *